United States Patent [19]

Restivo

[11] 4,279,057

[45] Jul. 21, 1981

[54] PORTABLE SPOTTING TOOL FOR CARPETS

[76] Inventor: Edward A. Restivo, 81 Willowick Dr., Fairport, N.Y. 14450

[21] Appl. No.: 126,417

[22] Filed: Mar. 3, 1980

[51] Int. Cl.[3] ..... A47L 9/02

[52] U.S. Cl. ..... 15/415 R; 15/396; 15/422

[58] Field of Search ..... 15/393, 395, 396, 415 R, 15/422, 401; 68/240

[56] References Cited

U.S. PATENT DOCUMENTS

| | | | |
|---|---|---|---|
| 243,098 | 6/1881 | Becker et al. | 15/415 R X |
| 1,322,361 | 11/1919 | Sherman | 15/422 X |
| 2,081,597 | 5/1937 | Nowak | 15/401 X |
| 2,193,804 | 3/1940 | Dahlberg | 68/240 X |
| 2,533,263 | 12/1950 | Johnson | 15/422 X |
| 2,643,413 | 6/1953 | Buccasio | 15/396 |

*Primary Examiner*—Christopher K. Moore
*Attorney, Agent, or Firm*—Shlesinger, Fitzsimmons & Shlesinger

[57] ABSTRACT

Spots and stains are completely removed from wall-to-wall carpeting, upholstery fabric, and the like, by using a generally flat, hollow tool, which is inserted beneath the carpet or fabric without completely removing the latter from the floor or piece of furniture which it covers. The flat tool has a plurality of spaced perforations in its upper wall; and its interior is releasably connected by a tubular extension member to a vacuum supply which creates a localized vacuum immediately beneath the portion of the carpet that is to be cleaned. A liquid cleaning medium or solvent is then applied to the spot or stain which is located above the tool; and after it passes through the carpet or fabric it is drawn into the tool and through the extension member to the vacuum supply. The tool has a plane, perforated upper wall, and a compound lower wall, a first portion of which extends parallel to the upper wall to form a flat base for supporting the tool during use, and a second inclined portion of which extends upwardly toward the front of the tool so that the tool is tapered to ease its insertion beneath the carpet or upholstery fabric.

9 Claims, 4 Drawing Figures

PORTABLE SPOTTING TOOL FOR CARPETS

This invention relates to a tool for removing spots from carpets, or the like, and more particularly to a portable tool adapted to be used in conjunction with a liquid cleaning fluid for "on-the-job" removal of spots or stains from carpeting, upholstery, or the like.

In recent years wall-to-wall carpeting has become more commonplace in both residential and business dwellings. Moreover, in the case of many private homes such carpeting has taken the place of hardwood flooring, so that the owner is left with little option but to use wall-to-wall carpeting at all times. Obviously, however, because of accidents and/or prolonged use such carpeting eventually becomes stained or spotted. The cost of taking-up or completely removing such carpeting for cleaning purposes can be very time-consuming and expensive. Moreover, in those cases where it has been used as a substitute for hardwood floors, the floor supporting the carpeting is usually unfinished, and therefore presents a very unattractive surface during the period of time that the carpeting is away being cleaned.

As an alternative to removing such carpeting, efforts have been made to develop high-vacuum cleaning equipment for cleaning the carpeting in place—i.e., without removing it. Usually such equipment is used in conjunction with a liquid cleaning fluid, which is applied to the carpet with our without brushing agitation, after which a suction device is used for drawing the liquid, and presumably the dirt and stains, from the carpet. The disadvantage of this method of removing spots and stains is that spreading occurs with ink, paint, polish, etc., and further complicates problems. With animal urine, spreading and recontamination are serious problems because of the extreme odors they possess. Odor is usually left behind in backing, padding and flooring. Consequently, prior such equipment of the type described has not been satisfactory because it does not function completely to remove the cleaning solvents and the materials causing the spots or stains.

The difficulty in removing such spots from a carpet is compounded in the case of urine stains caused by household pets and the like. Although there are cleaning solutions which are capable of dissolving the urine stains, nevertheless, until applicant's invention there has been no satisfactory equipment for on-the-spot removal of the cleaning compound and offensive staining materials. Generally, as noted above, the urine stain, even after having become solvent in the cleaning fluid, remains in the back of the carpeting or in the surface of the underlying floor.

What has been said above applies also to a great extent to upholstery fabric. I.e., when efforts are made to clean upholstery with a liquid cleaning fluid in combination with a vacuum device, the liquid fluid tends to penetrate through the upholstery fabric and into the fabric or foamed material covered by the fabric, so that it is, in essence, impossible to suck or withdraw the cleaning fluid back up through the upholstery fabric regardless of the type of vacuum device employed.

It is an object of this invention, therefore, to provide a novel process for on-the-premises removal of spots and stains from wall-to-wall carpeting, upholstery fabrics, and the like.

Another object of the invention is to provide a novel tool for use in removing spots and stains from wall-to-wall carpeting and the like, and without having completely to remove the carpeting from the floor which it covers.

A further object of this invention is to provide a novel tool of the type described which is portable, and which is adapted readily to be connected to a vacuum source for instantly removing from carpeting, upholstery fabrics and the like, liquid cleaning fluids which are employed for dissolving stains or foreign substances in the carpeting or fabric that is being cleaned.

Another object of this invention is to provide a tool of the type described which is adapted to be used in connection with an extensible handle section which can be used for sliding the tool for extended distances beneath, for example, a section of wall-to-wall carpeting, only portions of which have been removed from the teeth of the carpet anchoring strips which are conventionally used for securing such carpeting in place.

Other objects of the invention will be apparent hereinafter from the specification and from the recital of the appended claims, particularly when read in conjunction with the accompanying drawings.

Figure 1:
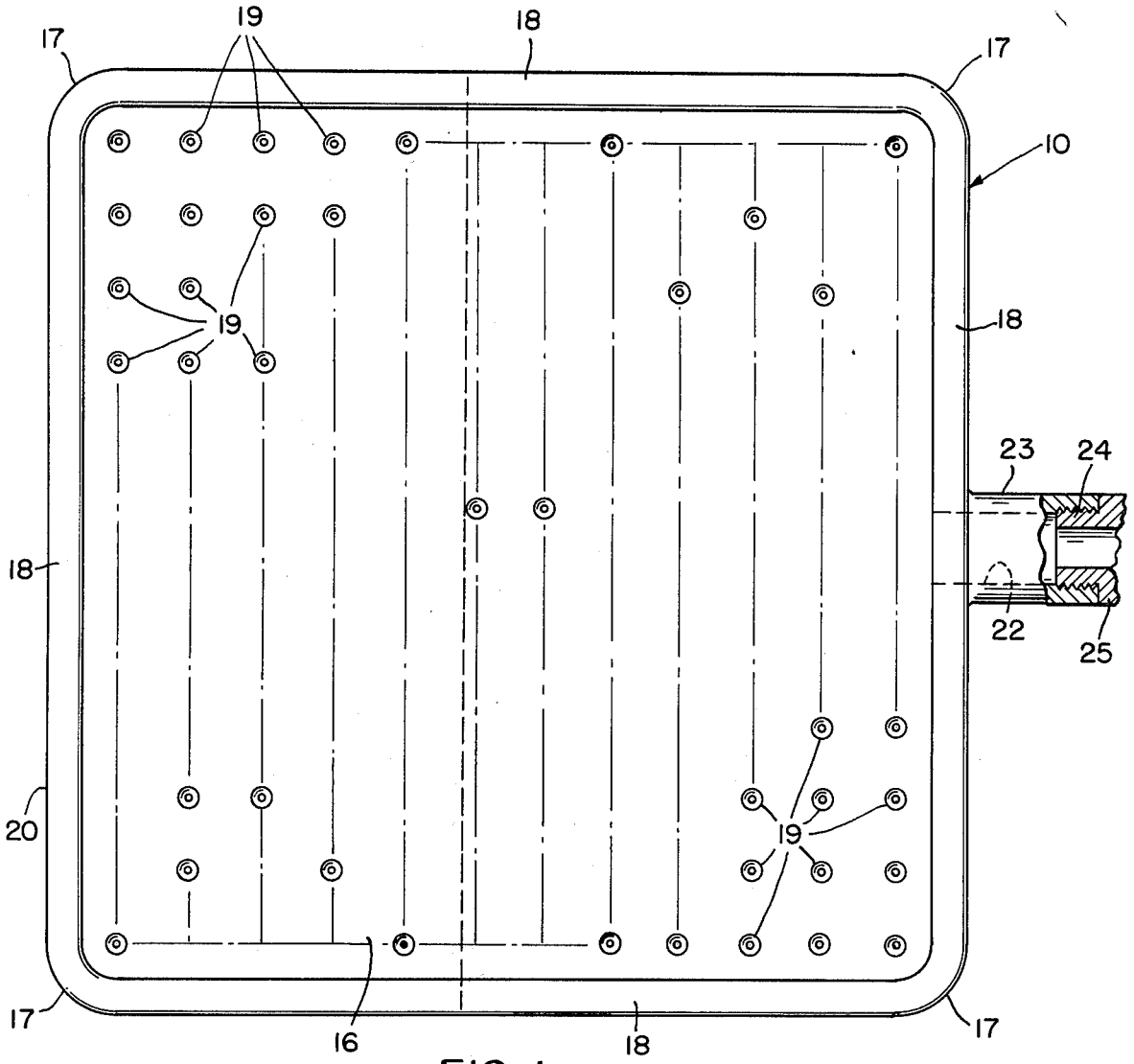
FIG. 1 is a plan view of a portable spotting tool made according to one embodiment of this invention, with a portion of the tool being broken away and shown in section to illustrate one manner in which it can be releasably attached to a tubular extension, only a portion of which extension is shown fragmentarily in FIG. 1.

Referring now to the drawings by numerals of reference, and first to FIGS. 1 to 3, 10 denotes generally a portable spotting tool comprising a rigid, hollow housing having a compound bottom wall 11, a pair of spaced, parallel side walls 12 and 13, forward and rear walls 14 and 15, respectively, which extend parallel to each other and transversely between opposite ends of the side walls 12 and 13, and plane top wall or cover 16, which is integral with, or secured to, the coplanar edges of walls 12 to 15. The upper wall 16, which is generally rectangular in configuration, has rounded corners 17, and is surrounded by an integral bead flange 18, which projects slightly above the upper surface of wall 16, and which has an arcuate or rounded upper surface when viewed in cross section. The upper wall 16 also has therethrough a plurality of small openings or perforations 19, which are arranged in intersecting rows and columns, but only certain of which perforations have been shown in FIG. 1.

Figure 2:
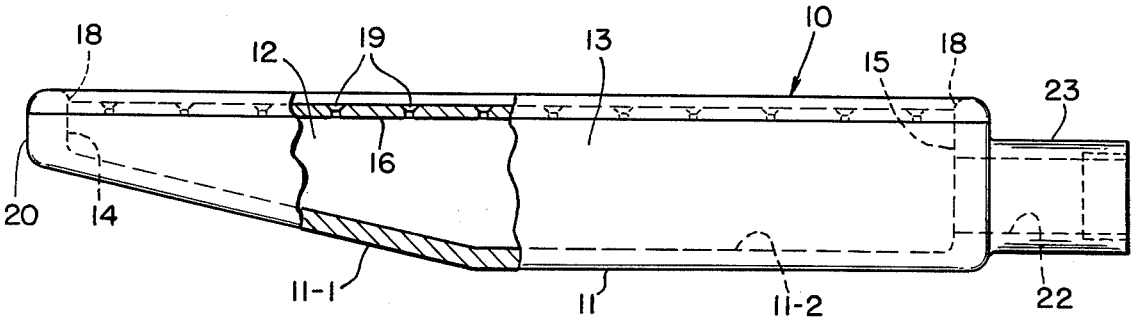
FIG. 2 is a side elevational view of this tool, again with a portion thereof being broken away and shown in section.
Figure 3:
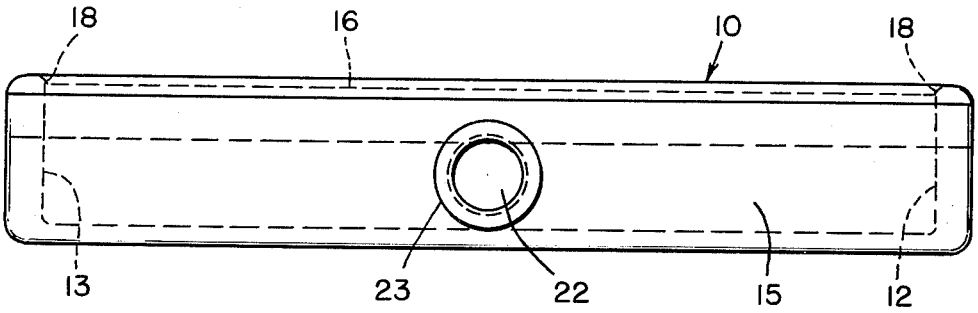
FIG. 3 is an end elevational view of this tool as seen when looking toward the right end of the tool as shown in FIG. 2.

As shown more clearly in FIG. 2, the forward wall 14 of the tool is substantially shorter than that of the rear wall 15, and is integrally connected along its lower edge to the forward or upper end of an inclined portion 11-1 of the compound bottom wall 11. This inclined portion 11-1 of the wall is integral at its rear or trailing edge with the forward edge of a plane, flat portion 11-2 of the bottom wall, which is disposed in spaced, parallel relation to the upper wall 16 of the tool. The inclined wall portion 11-1 extends for approximately ½ the width of the tool as viewed in FIG. 2, so that substantially the forward half of the tool (the left hand half as shown in FIG. 2), is tapered so that its forward or leading edge 20 (FIGS. 1 and 2) is extremely thin as compared to its rear or trailing edge, as represented by the rear wall 15.

A central opening 22 in the rear wall 15 of the tool communicates with the bore of a small pipe or nipple 23, which is integral with or secured to the tool wall 15 in registry with opening 22. In the embodiment illustrated the nipple 23 has an internally threaded outer end into which the externally threaded tubular shank 24 (FIG. 1) of a tubular extension member 25 is adapted to be threaded.

Figure 4:
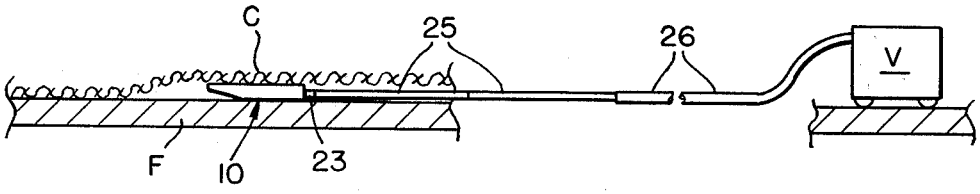
FIG. 4 is a fragmentary diagrammative view illustrating one manner in which the tool can be utilized for spotting purposes.

In use, one or more extension members 25 are adapted to be secured as shown in FIG. 4 to the fitting 23 in order to provide a tubular extension for the tool 10. The outer or terminal end of the last extension member in the series is adapted to be connected in a conventional manner by an elongate tube or hose 26 to a conventional vacuum device V of the portable variety. Device V can be brought to a dwelling or the like for use in connection with the tool 10 for cleaning or spotting rugs, carpets, upholstery, or the like.

Assuming for example that the tool 10 is to be used for removing spots from a carpet C, a portion of which has been released so that the tool 10 can be inserted manually beneath the carpet between it and the floor F, as shown in FIG. 4, the operator positions the tool by means of the extensions 25 until the upper, perforated wall 16 of the tool is positioned beneath the spot that is to be removed. With the tool then connected to the vacuum V the operator then pours the cleaning fluid onto the spot on the carpet, and in such a manner that all excess cleaning fluid and dissolved materials collect on the recessed upper surface of the tool 10—i.e., on the surface which is surrounded by the bead flange 18. During this time, or shortly thereafter, the vacuum device is operated to create through the tool holes 19 a suction beneath the carpet in registry with the portion to which the cleaning solution has been applied, so that either during the rubbing of the cleaning solution into the carpet, or immediately thereafter, the vacuum created in the tool housing will cause the cleaning fluid, foreign dust and dirt particles, and the like, to be drawn completely through the carpet C and into the tool 10, and from there through the tubular connectors 25 and hose 26 to a vacuum source. After the spot has been removed the tool 10 can withdrawn from beneath the carpet to allow the latter to resettle onto the floor F. Thereafter, if necessary, the portion of the carpet which had been released can be resecured to the floor. Alternatively, after the tool 10 has been removed the portion of the carpet which is then damp or wet can be held above the surface of the floor F until the carpet dries.

From the foregoing it will be apparent that the novel tool disclosed herein considerably expedites the cleaning and spotting of carpets or upholstery fabrics, as compared to prior such methods. With applicant's tool it is not necessary to remove the entire carpet or fabric from the floor or from a piece of furniture. Instead tool 10 can be slid beneath the spotted portion of the carpet or fabric, and with its discharge tube 23 connected to a vacuum source the cleansing fluid can then be poured, rubbed, or otherwise applied to the carpet or fabric above the apertured surface of the housing wall 16, so that both the cleaning fluid and the offending materials which caused the spot will be completely removed during the cleaning operation. This novel cleaning method leaves no residue as was the case of known, prior cleaning methods, wherein both the cleaning fluid and the vacuum source were applied from above the carpet or fabric. Because of the tapered design of the forward portion of the hollow tool 10, it is a relatively simple matter to insert the tool even beneath wall-to-wall carpeting which remains for the most part secured to the associated floor. Only the smallest slack is required in the carpet in order to insert the tool 10; and the ease of inserting the tool 10 can be enhanced by placing two or small wheels or rollers on its underside for rolling contact with the floor covered by the carpeting that is to be cleaned. Moreover, by using the removable extension members 25 it is a simple matter to insert the tool for long distances beneath such carpeting.

By rounding the corners and edges of the tool, as shown in the drawings, the tool does not tend to snag or otherwise catch on the surface of the carpet or fabric beneath which the tool is being inserted. Moreover, the beaded flange 18 around the outer surface of the upper housing wall 16 prevents the liquid cleaning fluid from spreading beyond the outline of the tool, under normal circumstances. In addition, by utilizing a plurality of closely spaced apertures or holes in the upper wall 16, it is possible to distribute the vacuum rather uniformly beneath the spot which is being cleaned. Also, while the inclined surface 11-1 eases the insertion of the tool 10 beneath the material that is to be cleaned, it also tends to direct the incoming fluids rearwardly in the housing toward the discharge opening 22.

In practice the herein described tool has been found to be extremely useful in removing animal urine from carpets and upholstery. Normally for removing animal urine an active alkaline protein-type enzyme is employed completely to digest urine deposits. Unfortunately, however, when utilizing previously known methods, the digested or dissolved deposits tended to soak into the pile and jute or synthetic backings of the carpet. This problem is obviated with applicant's tool, which, when placed beneath the carpet or fabric rather than above it, functions completely to remove both the cleaning fluid and the dissolved or digested urine deposits, or other spot-forming deposits.

While in the embodiment illustrated the extensions 25 have been shown to comprise tubular members which thread into the discharge fitting 23 of the tool, it will be appreciated by one skilled in the art that the particular manner in which the extension devices are attached to the tool, or to each other, can be varied without departing from this invention. Likewise, while the perforations 19 in the upper surface of the tool are shown to be arranged in parallel rows and parallel columns, it will be appreciated also that the disposition or relative sizes of these apertures could also be varied without departing from the invention. Moreover, while the tool has been shown to be generally rectangular in configuration, it will be appreciated also that the exact shape of the tool could be altered, provided that it retains along its forward edge the narrow or tapered configuration which enables it to be inserted beneath a carpet or fabric which remains rather tautly stretched across the associated floor or piece of furniture. It will be appreciated also that this invention is capable of further modification and that this application is intended to cover any such modifications as may fall within the scope of one skilled in the art or the appended claims.

Having thus described my invention, what I claim is:

1. A portable spot removing device for fabric covers, comprising a vacuum source, a hollow, generally flat tool having a plane upper wall, a lower wall spaced beneath and attached to said upper wall, and forward and rear walls, respectively, extending transversely between said upper and lower walls, said upper wall having therethrough a plurality of spaced apertures, and disposed to be placed horizontally beneath the portion of the fabric cover that is to be cleaned, and means for connecting said vacuum source to the interior of said tool, said means comprising a tubular member connected at one end to an opening in said rear wall of said tool, and having its opposite end operatively connected to said vacuum source, and at least a portion of said lower wall of said tool being inclined upwardly from adjacent said rear wall to said forward wall, whereby the thickness of the tool is tapered adjacent its forward wall to ease its insertion beneath a fabric cover and the item which it covers.

2. A portable spot removing device as defined in claim 1, wherein said means comprises a plurality of said tubular members releasably attachable one to the other to form an elongate tubular connection between said tool and said vacuum source, at least the first tubular member connected to said tool being rigid thereby to provide a handle for manipulation of the tool beneath a fabric cover.

3. A portable spot removing device as defined in claim 2, wherein said upper wall has an integral flange extending around the outside thereof, and projecting slightly above the upper surface of said upper wall to form a central recess therein.

4. A portable spotting tool adapted to be inserted manually beneath a fabric cover, or the like, without removing the cover, comprising a generally flat, hollow housing having a plane, perforated upper wall, a compound lower wall spaced beneath said upper wall, and forward and rear edges, respectively, and means for connecting the interior of said housing to a vacuum supply to create a vacuum in said housing beneath said perforated upper wall, said lower wall having a first portion thereof disposed in spaced, parallel, registering relation with part of said upper wall and operativve to provide a supporting surface for said tool during its use, and having a second portion thereof disposed in an inclined plane intersecting said forward edge of said housing and said first portion of said lower wall.

5. A portable spotting tool as defined in claim 4, wherein said second portion of said lower wall is inclined at an acute angle to said upper wall and at an obtuse angle to said first portion of said lower wall, whereby the thickness of said tool is tapered adjacent its forward edge.

6. A portable spotting tool as defined in claim 5, wherein the exterior edges of said tool are rounded to prevent snagging when the tool is inserted beneath a fabric cover.

7. A portable spotting tool as defined in claim 4, wherein said connecting means comprises a plurality of tubular extension members releasably attachable coaxially to each other and to an opening in said rear edge of said tool to provide a handle for manipulating said tool beneath a carpet, or the like, and operable to connect the interior of said tool to said vacuum supply.

8. A portable spotting tool as defined in claim 4, including a bead flange integral with and surrounding said upper wall, and projecting slightly above the upper surface of said upper wall.

9. A portable spotting tool as defined in claim 4, wherein said upper wall has therethrough a plurality of spaced perforations arranged in parallel rows and parallel columns intersecting said rows.

* * * * *